US008183446B1

(12) United States Patent
Ward

(10) Patent No.: US 8,183,446 B1
(45) Date of Patent: May 22, 2012

(54) TWO STAGE, SINGLE LEVER, SNAP ACTION LATCH FOR COLLAPSIBLE STRINGED MUSICAL INSTRUMENT

(76) Inventor: John Robert Ward, Costa Mesa, CA (US)

( * ) Notice: Subject to any disclaimer, the term of this patent is extended or adjusted under 35 U.S.C. 154(b) by 0 days.

(21) Appl. No.: 12/803,724

(22) Filed: Jul. 3, 2010

(51) Int. Cl.
*G10D 1/10* (2006.01)

(52) U.S. Cl. ..... 84/267

(58) Field of Classification Search ..... 84/267, 84/290–293
See application file for complete search history.

(56) References Cited

U.S. PATENT DOCUMENTS

| | | | | |
|---|---|---|---|---|
| 5,353,672 | A | 10/1994 | Stewart | |
| 6,028,255 | A | 2/2000 | Myronyc | |
| 7,375,267 | B2 | 5/2008 | Poschelk | |
| 2007/0289427 | A1 * | 12/2007 | Liang | 84/291 |

* cited by examiner

*Primary Examiner* — Kimberly Lockett

(57) ABSTRACT

This is an improved latch for a collapsible stringed musical instrument providing for a two step assembly or disassembly and combining all operations into a single lever, knob, or cam. A snap action catch holds the instrument in the intermediate position, resisting the stings tension, allowing for a second step to tighten or loosen the neck to the body of the instrument without de-tuning the instrument's strings.

1 Claim, 5 Drawing Sheets

Figure 1:
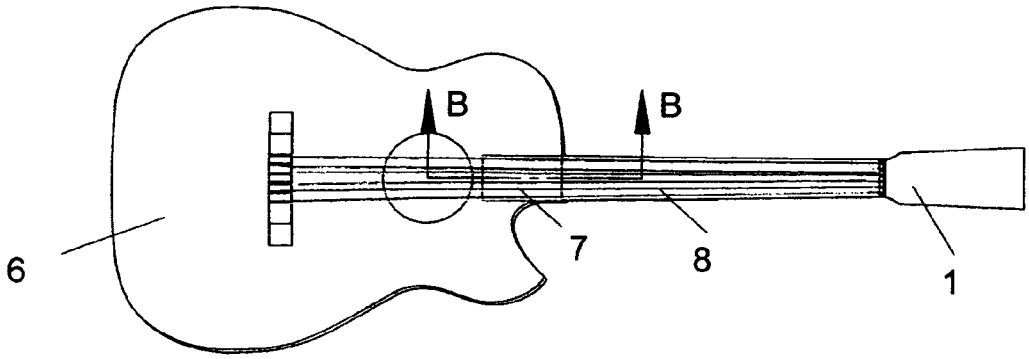

TWO STAGE, SINGLE LEVER, SNAP ACTION LATCH FOR COLLAPSIBLE STRINGED MUSICAL INSTRUMENT

FIELD OF INVENTION

This invention relates to collapsible stringed musical instruments

BACKGROUND

Prior Art

The following is a tabulation of some prior art that presently appears relevant:

| U.S. Patents | | | |
|---|---|---|---|
| Pat. No. | Kind Code | Issue Date | Patentee |
| 5,353,672 | | Oct. 11, 1994 | Stewart |
| 6,028,255 | | Feb. 22, 2000 | Myronyc |
| 7,375,267 | B2 | May 20, 2008 | Poschelk |

A conventional stringed musical instrument is normally an assembly of a neck and body in one piece. Many of the instruments are too large for convenient travel as hand luggage on airplanes, and must be checked with the airline and transported in the baggage hold of the airplane, subjecting the instruments to damage from rough handling and crushing. In order to allow carrying onboard as hand luggage, some of these instruments have a neck to body joint that allows folding and or separation of the two parts, thus reducing the length of the instrument to an acceptable size.

It is also helpful to be able to fold or separate the neck from the body without reducing the tension in the strings. This greatly reduces the time and effort required to re-tune the instrument after assembly, as well as reducing the time required for disassembly.

But, the instrument is relatively large and delicate, requiring care in handling while assembling and disassembling. Force is required to hold the neck to body joint in place against the tension force in the strings while simultaneously tightening or loosening the fixings. Also, moving the neck against the tension in the strings requires a different grip than tightening or loosening its connection to the body.

Therefore, it is advantageous to have a latch that holds the guitar assembly in an intermediate position in order to allow for the user to re-grip the instrument and complete the assembly or disassembly.

For assembly, it is easier if the latch has a snap action feature that automatically engages and holds the two parts of the instrument in an intermediate position. This feature allows the neck to be pushed into the intermediate position and held there by the latch until the tightening procedure can be accomplished.

For disassembly, it is easier if the latch releases is in 2 steps. The first step allows the neck to separate from the body to an intermediate position, releasing some spring tension, and the latch holding the neck in this position until the latch is completely released.

Finally, it is easier and more efficient if the latch is operated by manipulating only one element of the latch.

Several types of quick disconnect necks have been proposed. One has no means for intermediate position latching, requiring the user to hold the neck in place against the tension of the strings while simultaneously latching the neck in place.

U.S. Pat. No. 7,373,267 B2 to Poschelk (2008) proposes such a latch, using a cam lever system mounted to the bottom of the body of the instrument.

Two other proposals have the preferred intermediate position for latching, although neither one proposes a single lever for latch operation.

U.S. Pat. No. 535,672 to Stewart (1994) proposes various snap action latches with separate tightening screws. One embodiment (FIG. 9) proposed a snap action latch combined with a tightening screw, but this embodiment offers no means of releasing the latch for disassembly.

U.S. Pat. No. 6,028,255 to Myronyk (2000) proposes two latch systems that uses a cam lever for final tightening. One proposal uses a separate knob is used to load the latch arm to engage or disengage. The second proposal uses a system similar to a ball point pin whereby alternating pushes of the cam lever will load the latch springs to engage or disengage.

ADVANTAGES

Accordingly several advantages of one or more aspects my invention are a latch assembly, operated by a single lever, cam, or screw that provides for:

(a) assembly and disassembly of the body to neck joint without de-tuning or slacking string tension, and
(b) provides an intermediate snap action latching position against the tension force of the strings, and
(c) provides an integral one step release from this intermediate position, and
(d) provides an integral tightening mechanism to hold the joint in its assembled position, and
(e) does not adversely affect the musical tone and vibration characteristics of the instrument.

Other advantages of one or more aspects will be apparent from a consideration of the drawings and ensuing description.

DRAWINGS

Reference Numerals—all Embodiments Shown

1 Neck
2 Latch Arm
3 Latch Arm Pivot
4 Thrust Washer
5 Thumb Screw
6 Body
7 Neck Extension
8 Strings
9 Cam Lever
10 Catch Pin
11 Latch Housing
12 Spring 1
13 Snap Ring
14 Spring Shoe
15 Cam Screw
16 Spring 2

DRAWINGS

Figures 1$^{St}$ Embodiment

Figure 1A:
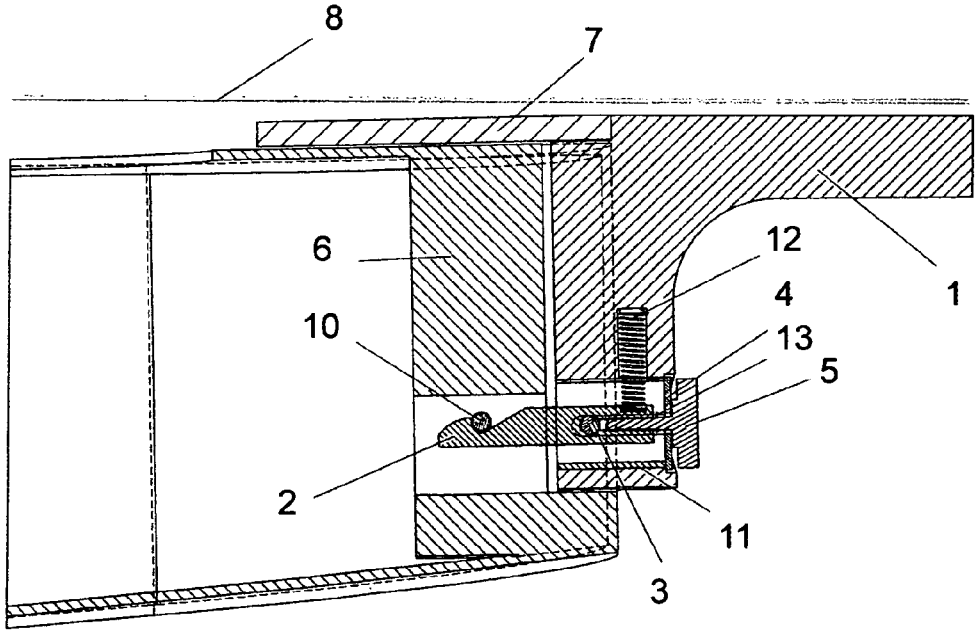
Figure 1B:
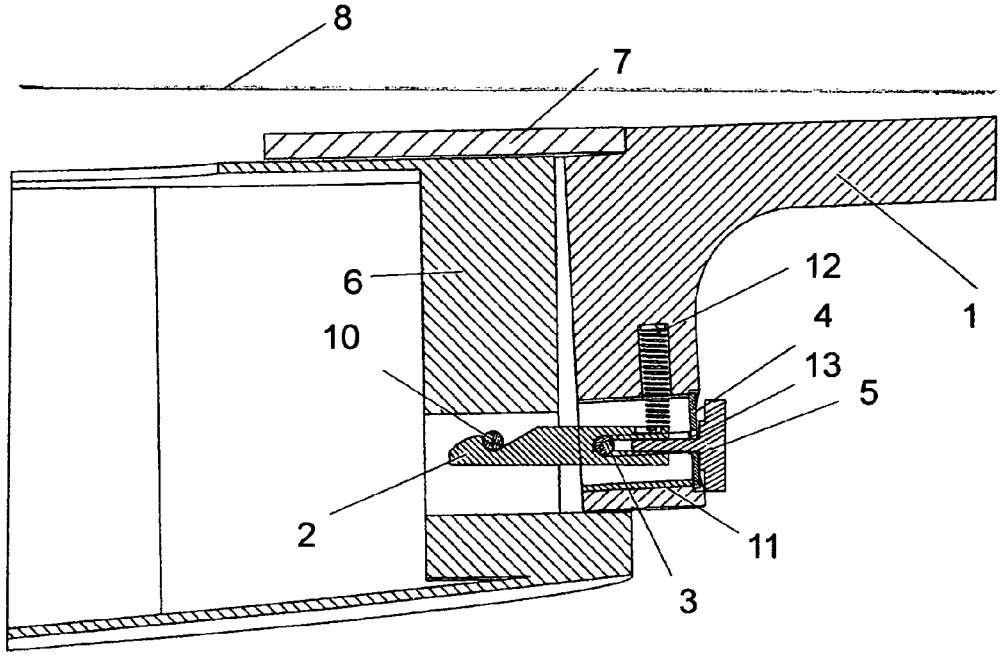
Figure 1C:
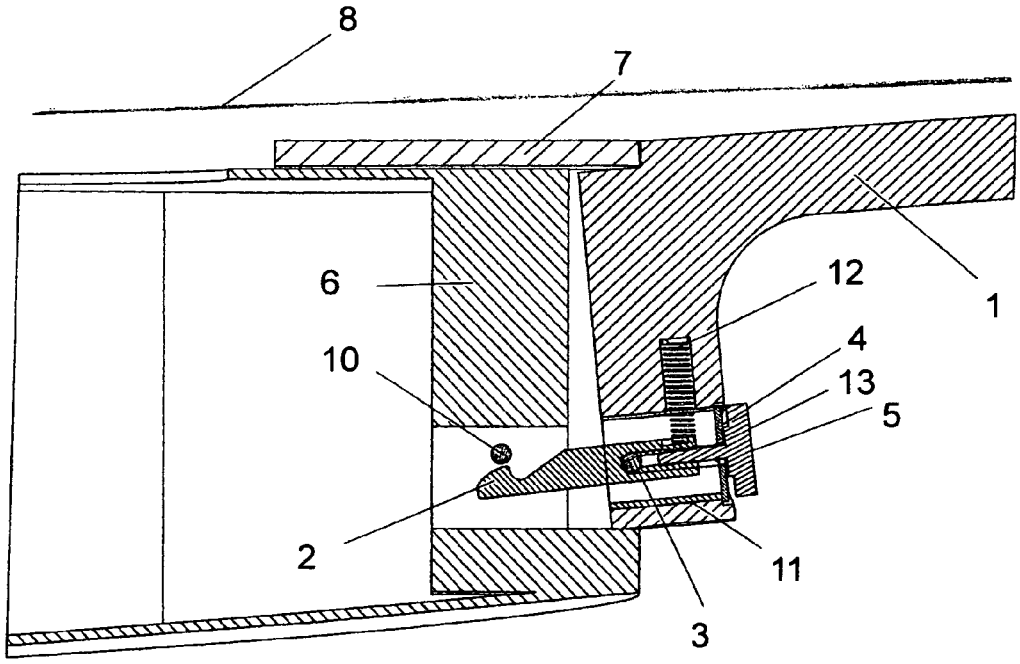
Figure 1D:
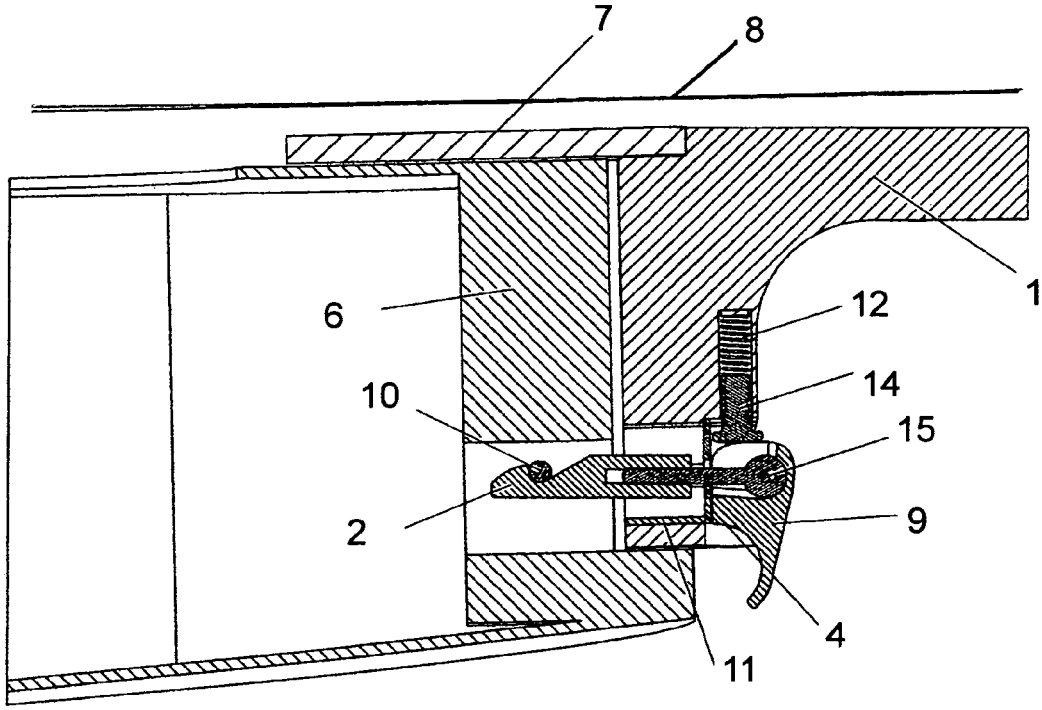
Figure 1E:
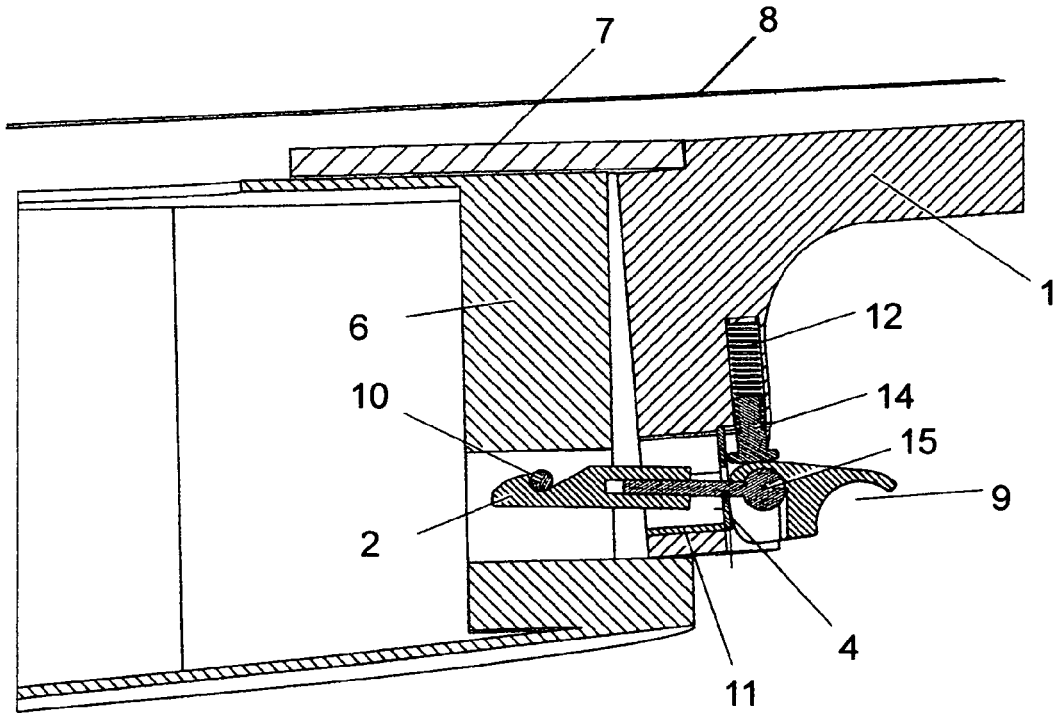
Figure 1F:
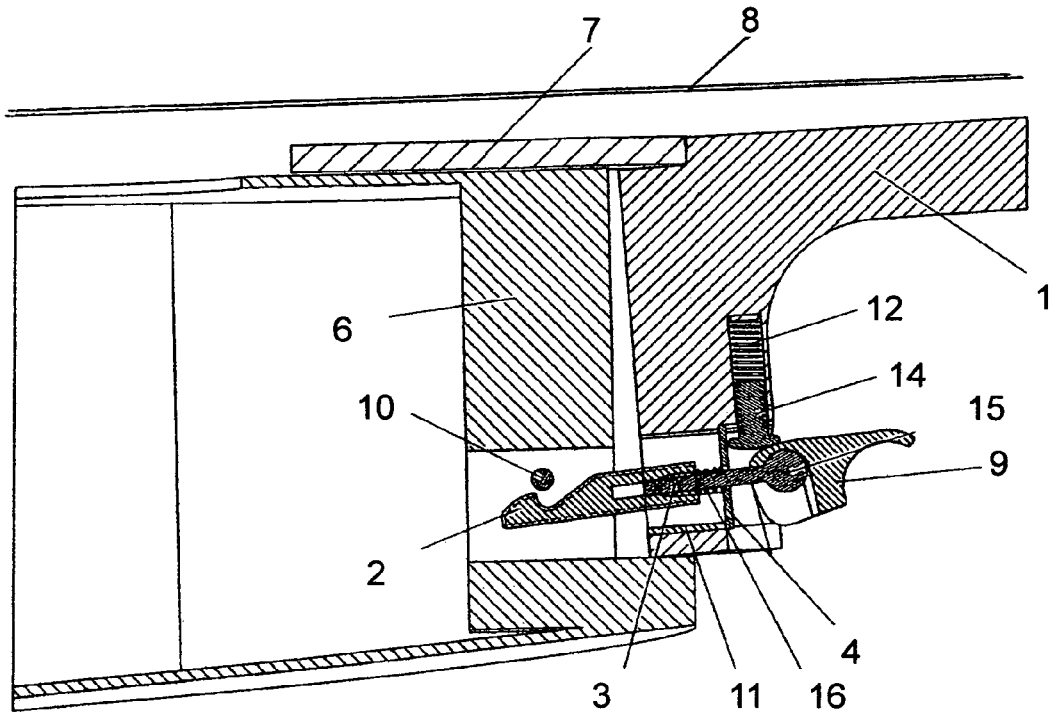
Figure 2:
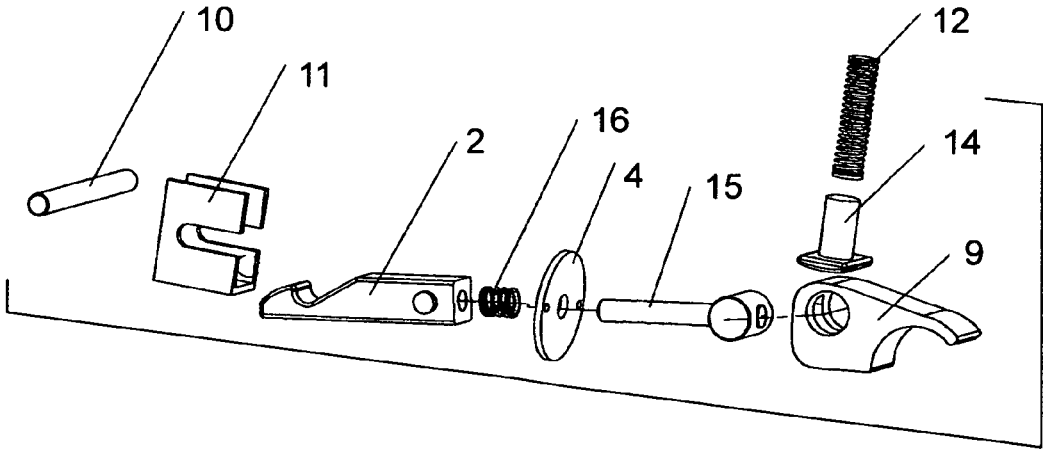
Figure 3:
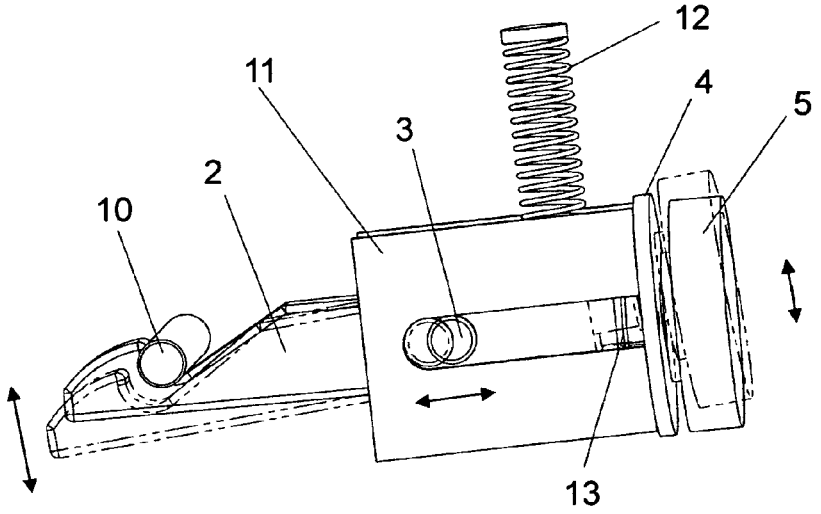
Figure 4:
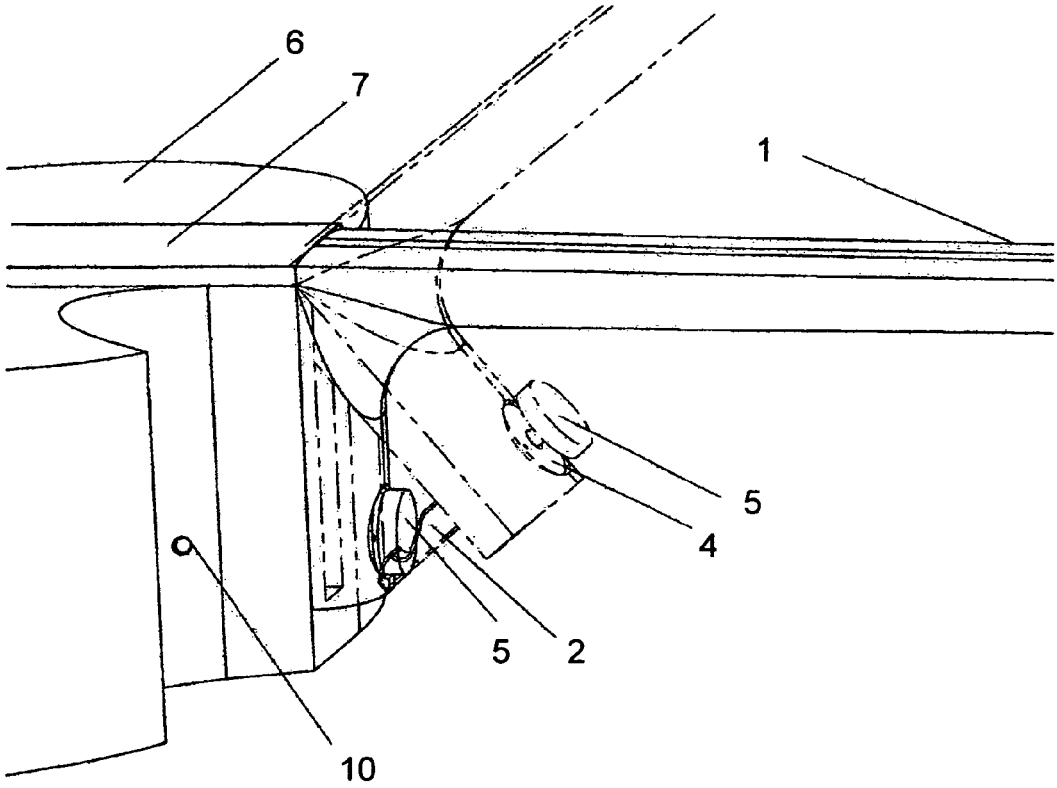

FIG. 1 is a top view of a guitar,

FIG. 1A is a partial section view of the neck to body joint in the assembled position, FIG. 1B is a partial section view of the neck to body joint in the intermediate position, FIG. 1C is a partial section view of the neck to body joint in the initial released position, FIG. 1D is a partial section view of the neck to body joint in the assembled position (spring 16 not shown), FIG. 1E is a partial section view of the neck to body joint in the intermediate position (spring 16 not shown), FIG. 1F is a partial section view of the neck to body joint in the initial released position, FIG. 2 is an exploded view of the latch components only, FIG. 3 is a view of the latch components only and their relative movements, FIG. 4 shows a neck to body joint in the assembled and hinged positions

DETAILED DESCRIPTION

1$^{St}$ Embodiment

One embodiment of the latch is illustrated in FIG. 1 (top view), FIG. 1A (partial section assembled position), FIG. 1B (partial section assembled position), and FIG. 1C (partial section released position). FIG. 3 shows the latch components isolated from the body and neck. A latch housing 11 is glued or fixed to a neck 1 and provides a guide channel for the latch arm 2 and a latch pivot pin 9 to translate and pivot as shown. A catch pin 10 is fixed to a body 6 and a spring 12 provides a restoring force to engage the latch arm 2 with the catch pin 10. A thrust washer 4 is fixed to the neck 1 and provides a surface for a thumb screw 5 to bear on and pull the neck 1 tightly to the body 6 via its threaded connection to the latch arm 2 and also a surface for a snap ring 13 to bear on. The snap ring 13 is mounted on a groove in the thumb screw 5. The thrust washer 4 has a slotted hole to allow the thumb screw 5 to move up and down, thus moving the latch arm 2 relative to the catch pin 10. FIG. 4 shows the neck 1 hinging around its abutment to a neck extension 7 and thus completely releasing all the strings 8 tension.

OPERATION

Starting with the assembled instrument, loosen the thumb screw 5 until the snap ring 13 bears on the thrust washer 4 allowing the neck 1 to hinge about its abutment with the neck extension 7 thus slightly releasing the strings 8 tension. The latch will hold the instrument in this partially disassembled position. The entire instrument can be re-positioned to push down on the neck to slightly relieve the force on the latch arm 2 to the catch pin 10 connection. Push up on the thumb screw 5 to rotate and release the latch arm 2 from the catch pin 10, then release the downward pressure on the neck 1 to complete disassembly of the joint. Assembly requires pushing down on the neck 1 to engage the latch arm 2 with the catch pin 10. The latch will hold the instrument in this partially assembled position, allowing the user to re-position the entire instrument and tighten the thumb screw 5 to bring the neck 1 to body 6 joint to the assembled position.

ALTERNATIVE EMBODIMENT

DETAILED DESCRIPTION—ALTERNATIVE EMBODIMENT

Another embodiment of the latch is illustrated in FIG. 1 (top view), FIG. 1D (partial section assembled position), FIG. 1E (partial section intermediate position), FIG. 1F (partial section initial released position), and FIG. 2 an exploded view showing the latch components isolated from the body and neck. The latch housing 11 is glued or fixed to the neck 1 and provides a guide channel for the latch arm 2 and latch pivot pin 3 to translate and pivot. The catch pin 10 is fixed to the body and the spring 12 provides the restoring force to engage the latch arm 2 with the catch pin 10. The thrust washer 4 is fixed to the neck 1 and provides a surface for the cam lever 3 to bear on and also a surface for a spring 13 to bear on. Spring 13 provides the restoring force to keep the latch arm 2 extended toward the catch pin 10. A cam lever 9 pulls the neck tightly to the body 6 via its pinned connection to a cam screw 15 and the cam screw 15 threaded connection to the latch arm 2. The cam screw 15 threaded connection to the cam lever 9 provides a method for tension adjustment. The thrust washer 4 has a slotted hole to allow the cam lever 9 and cam screw 15 to move up and down, thus moving the latch arm 2 relative to the catch pin 10, releasing the neck 1 and allowing the neck 1 to hinge around its abutment to the neck extension 7 and thus completely releasing all the strings 8 tension.

OPERATION OF ALTERNATIVE EMBODIMENT

Starting with the assembled instrument, rotate the cam lever 9 until the cam lever shoulder bears on the cam screw 15 allowing the neck 1 to hinge about its abutment with the neck extension 7 thus slightly releasing the strings 8 tension. The latch will hold the instrument in this partially disassembled position. The entire instrument can be re-positioned to push down on the neck 1 to slightly relieve the force on the latch arm 2 to catch pin 10 connection. Push up on the cam lever 9 to rotate and release the latch arm 2 from the catch pin 10, then release the downward pressure on the neck 1 to complete disassembly of the joint. Assembly requires pushing down on the neck 1 to engage the latch arm 2 with the catch pin 10. The latch will hold the instrument in this partially assembled position, allowing the user to re-position the entire instrument and rotate the cam lever 9 to bring the neck 1 to body 6 joint to the assembled position.

ADVANTAGES

From the description above, a number of advantages of some embodiments of my invention become evident:

(a) The latch provides a 2 step process for assembly or disassembly of the instrument thus making it easier for the user to control the forces coming from the string tension.

(b) The latch consists of a cam, lever, or screw that tightens or loosens the connection between the separate parts of the instrument, thus moving the parts between the assembled position and the intermediate position (c) On assembly, the separate parts of the instrument are pushed together causing the latch to snap and hold the parts in partially assembled position, allowing the user to re-grip the instrument for final assembly.

(d) On disassembly, the latch is released allowing the separate parts of the instrument to move away from each other, slightly releasing string tension, and allowing the user to re-grip the instrument for final disassembly.

(e) The latch is a compact assembly requiring the user to manipulate only one latch element for all operations.

(f) The instrument can be assembled and disassembled without slacking or de-tuning the strings reducing the time and effort required to perform those operations (g) Any stringed instrument with a neck can be reduced in size so as to make it more convenient for travel.

(h) The latch does not require large modifications to the normal construction and characteristics of an industry standard stringed instrument.

CONCLUSIONS, RAMIFICATIONS, AND SCOPE

Accordingly, the reader will see that at least one embodiment of my latch provides an easier to use collapsible stringed musical instrument. Also, my latch will not alter the basic industry standard shape for stringed musical instruments. My latch can be used on, but not limited to, solid body guitars, hollow body guitars, banjos, mandolins, violins, and ukuleles. My latch makes travel with a collapsible stringed musical instrument a more practical alternative than travel with non-collapsible stringed musical instruments.

While my latch has been described and defined by reference to the embodiments shown, such reference does not imply a limitation on the scope of the embodiments, and no such limitation is to be inferred. My latch is capable of considerable modification, alteration, and equivalents in form and function, as will occur to those ordinarily skilled and knowledgeable in the pertinent arts. The depicted and described embodiments of my latch are exemplary only, and is not exhaustive of the scope my invention. Consequently, the scope is intended to be limited only by the spirit and scope of the appended claims, giving full cognizance to equivalents in all respects.

I claim:

1. A multi-stage single lever latch for assembly and disassembly of a collapsible stringed musical instrument comprising:

(a) a body of said collapsible stringed musical instrument, (b) a neck of said collapsible stringed musical instrument, (c) a latch arm attached to said body and a catch attached to said body, (d) alternatively a latch arm attached to said neck and a catch to said body, (e) said latch arm having a geometric shapes for engaging with said catch as a means of transferring force, (f) said catch having a geometric shape for engaging said latch arm as a means of transferring force, (g) said catch and said latch arm having geometric shapes that allow said catch to slide past said latch arm into a position disposed for engagement, (h) a spring type element attached to said latch arm or said catch as a means to provide a restoring force to snap said latch arm into engagement with said catch when said latch arm and said catch are in a position disposed for engagement, (i) a cam, screw, or lever device attached to said latch arm or said catch as a means to cause said latch arm and said catch to translate or pivot as a means of controlling the gap between said neck and said body of said collapsible stringed musical instrument, (j) said cam, screw, or lever device attached to said latch arm or said catch as a means to cause said latch arm and said catch to translate out of engagement as a means of releasing the connection between said latch arm and said catch as a means to separate said neck and said body of said collapsible stringed musical instrument, (k) said cam, screw, or lever device attached to said latch arm or said catch as a means to cause said latch arm and said catch to translate as a means of urging said body and said neck of said collapsible stringed musical instrument into tight contact.

* * * * *